US006112040A

United States Patent [19]

Saito et al.

[11] Patent Number: 6,112,040

[45] Date of Patent: Aug. 29, 2000

[54] EXIT-STRUCTURE OF OZONE-EXHAUST DUCT INCORPORATED IN ELECTROPHOTOGRAPHIC IMAGE-FORMING APPARATUS

[75] Inventors: Hiroyuki Saito, Saitama; Kasumi Yamamoto, Tokyo, both of Japan

[73] Assignee: Asahi Kogaku Kogyo Kabushiki Kaisha, Tokyo, Japan

[21] Appl. No.: 09/432,180

[22] Filed: Nov. 2, 1999

[30] Foreign Application Priority Data

Nov. 5, 1998 [JP] Japan ..... 10-314191

[51] Int. Cl.[7] ..... G03G 21/20

[52] U.S. Cl. ..... 399/93

[58] Field of Search ..... 399/93, 92, 343; 454/49

[56] References Cited

U.S. PATENT DOCUMENTS 5,028,959 7/1991 Gooray ..... 399/93
5,068,684 11/1991 Abe et al. ..... 399/93
5,087,943 2/1992 Creveling ..... 399/93
5,155,531 10/1992 Kurotori et al. ..... 399/93
5,946,528 8/1999 Cho ..... 399/93

*Primary Examiner*—Arthur T. Grimley
*Assistant Examiner*—Remmon R. Fordé
*Attorney, Agent, or Firm*—Greenblum & Bernstein, P.L.C.

[57] ABSTRACT

An ozone-exhaust duct is incorporated in an electrophotographic printer to exhaust air, containing ozone and dust articles, and an exit structure of the duct is associated with an ozone-filter. In the exit-structure, a dust trapper is provided under an exit end portion of the duct near the ozone-filter to define a dust-trapping chamber such that a cross-sectional area of the exit end portion of the duct is increased in comparison with a cross-sectional area of a remaining portion of the duct, whereby a velocity of the air, introduced from the remaining portion of the duct into the exit end portion thereof, slows down, due to the existence of the ozone-filter and the increased cross-sectional area of the exit end portion of the duct, resulting in trapping of a part of the dust particles, contained in the introduced air, in the dust-trapping chamber of the dust trapper due to gravity.

7 Claims, 5 Drawing Sheets

EXIT-STRUCTURE OF OZONE-EXHAUST DUCT INCORPORATED IN ELECTROPHOTOGRAPHIC IMAGE-FORMING APPARATUS

BACKGROUND OF THE INVENTION

1. Field of the Invention

The present invention relates to an exit-structure, associated with an ozone-filter, of an ozone-exhaust duct incorporated in an electrophotographic image-forming apparatus, which may be constructed as a copier, a printer, a facsimile or the like.

2. Description of the Related Art

As is well known, the electrophotographic image-forming apparatus performs the processes of: electrically charging a surface of a photosensitive drum by a corona discharger; forming an electrostatic latent image the charged surface of the photosensitive drum by an optical writer such as a laser beam scanner; electrostatically developing the electrostatic latent image with developer, i.e. toner; electrostatically transferring the developed toner image to a recording paper by the corona discharger; and thermally fixing the transferred toner image on the recording paper.

The corona dischargers, used in the electrical-charging and electrostatic-transferring processes, produce ozone during electrical energization of the corona dischargers. Of course, since ozone is harmful to human health, the produced ozone should be eliminated so that the ozone cannot flow out of the electrophotographic image-forming apparatus.

Conventionally, to prevent the outflow of the ozone from the electrophotographic image-forming apparatus, the photosensitive drum and various elements (including the corona dischargers) associated therewith, are arranged in a semi-closed space, and an ozone-exhaust duct is laid so as to be in communication with the semi-closed space. An ozone-filter, which comprises, for example, activated charcoal, is detachably attached to an exit of the ozone-exhaust duct, and a fan is incorporated in the ozone-exhaust duct at a suitable location thereof. The fan is driven by an electric motor such that a negative pressure is produced in the semi-closed space, so that air containing ozone is sucked from the semi-closed space, and is then discharged outside through the ozone-exhaust duct. Of course, when the air containing ozone passes through the ozone-filter, the ozone is eliminated from the air, thereby preventing the outflow of the ozone from the electrophotographic image-forming apparatus.

The air, sucked from the semi-closed space, further contains paper dust particles derived from the recording paper, and toner particles derived from the toner developer used in the electrostatic-developing process. Especially, when a continuous type of recording paper is used in the electrophotographic image-forming apparatus, a large quantity of paper dust particles is produced in comparison with the use of cut sheet of paper as the recording paper, because the continuous type of recording paper has a plurality of perforated separation-lines from which paper dust particles are generated.

Of course, the dust particles, contained in the sucked air, are captured by the ozone-filter, and cause the premature obstruction of the ozone-filter. Thus, the ozone-filter must be frequently exchanged with a fresh ozone-filter before an effective elimination of the ozone from the air can be ensured.

SUMMARY OF THE INVENTION

Therefore, an object of the present invention is to provide an exit-structure, associated with an ozone-filter, of an ozone-exhaust duct incorporated in an electrophotographic image-forming apparatus, which is provided with a dust trapper for trapping dust particles, contained in an air flowing in the ozone-exhaust duct, whereby obstruction of the ozone-filter can be retarded.

Another object of the present invention is to provide an exit-structure as mentioned above, which is arranged such that the trapping of the dust particles from the air by the dust trapper is facilitated.

In accordance with the present invention, there is provided an exit-structure, associated with an ozone-filter, of an ozone-exhaust duct incorporated in an electrophotographic image-forming apparatus, to exhaust air containing ozone and dust particles. The exit-structure comprises a dust trapper that is provided under an exit end portion of the ozone-exhaust duct near the ozone-filter to define a dust-trapping chamber such that a cross-sectional area of the exit end portion of the ozone-exhaust duct is increased in comparison with a cross-sectional area of a remaining portion of the ozone-exhaust duct. Thus, a velocity of the air, introduced from the remaining portion of the ozone-exhaust duct into the exit end portion thereof, slows down, due to the existence of the ozone-filter and the increased cross-sectional area of the exit end portion of the ozone-exhaust duct, resulting in the trapping of part of the dust particles, contained in the introduced air, in the dust-trapping chamber of the dust trapper, due to gravity.

Preferably, the exit-structure further comprises a barrier element associated with the dust trapper and provided in the vicinity of the ozone-filter, such that the dust particles, once trapped in the dust-trapping chamber of the dust trapper, are prevented from being directed to the ozone-filter. The barrier element may be shaped as a plate-like element, which is partially projected from a lower side of the ozone-filter along a boundary between the dust-trapping chamber of the dust trapper and the exit end portion of the ozone-exhaust duct. The plate-like element may be formed as either a part of the ozone-exhaust duct or a part of the ozone-filter.

Preferably, the exit-structure further comprises a guide element provided in the exit end portion of the ozone-exhaust duct such that the air, introduced from the remaining portion of the ozone-exhaust duct into the exit end portion thereof, is positively directed toward the dust-trapping chamber of the dust trapper. The guide element is formed as a guide plate, which is securely attached to an inner surface of a top wall of the exit end portion of the ozone-exhaust duct, and which is gradually and downwardly curved, thereby obtaining the positive direction of the introduced air toward the dust-trapping chamber of the dust trapper.

BRIEF DESCRIPTION OF THE DRAWINGS

The object and other objects of the present invention will be better understood from the following description, with reference to the accompanying drawings in which.

DESCRIPTION OF THE PREFERRED EMBODIMENTS

Figure 1:
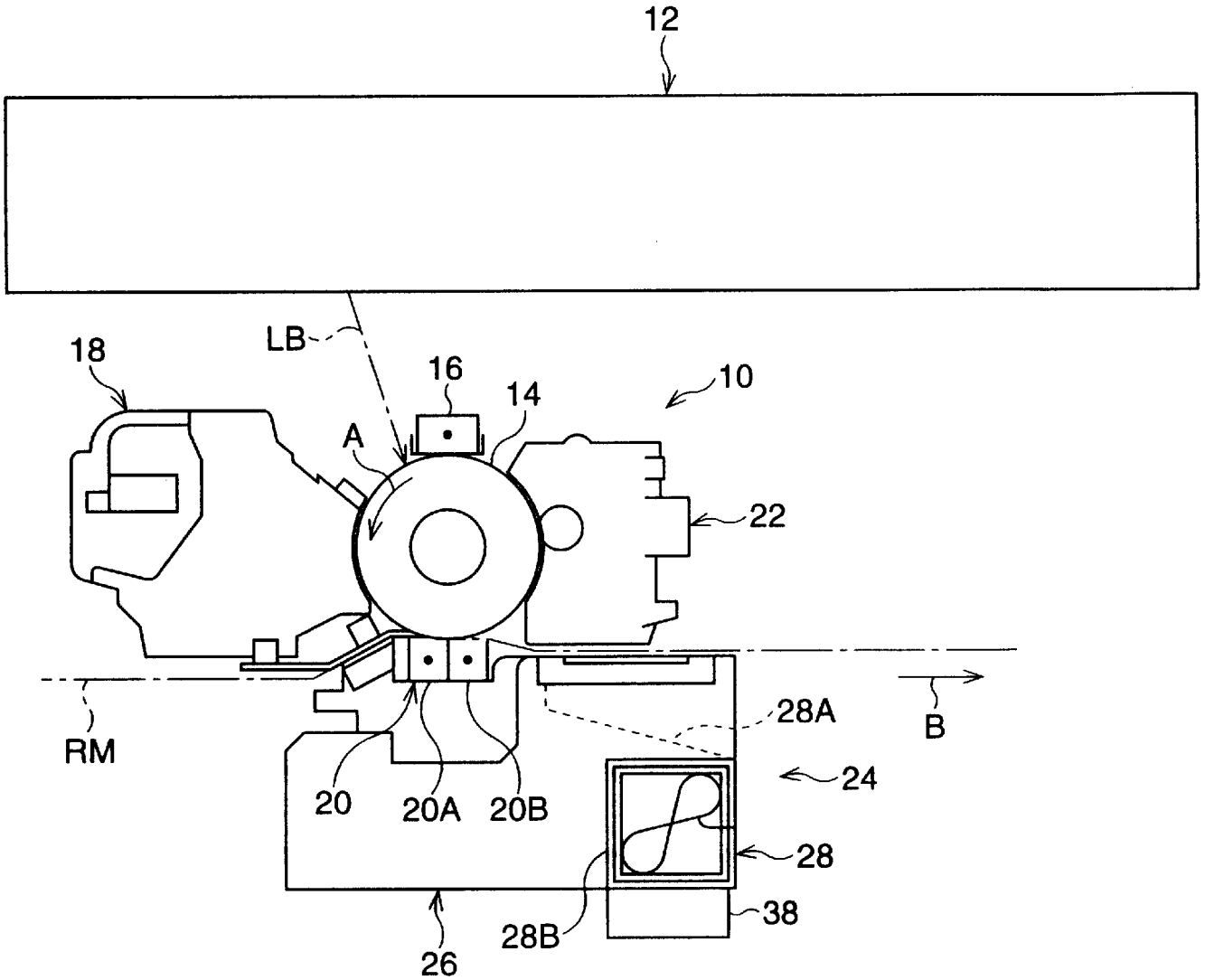
FIG. 1 is a schematic view of an electrophotographic printer including a printing unit and a laser beam scanner, in which the present invention is embodied.

FIG. 1 schematically shows an electrophotographic printer, in which the present invention is embodied, and comprises a printing unit, generally indicated by reference 10, which is disposed in a semi-closed space suitably defined by some partition elements in a printer housing, and a laser beam scanner, generally indicated by reference 12, which is associated with the printing unit 10. The laser beam scanner 12 includes a laser source such as a semiconductor laser diode for emitting a laser beam, and an optical deflector such as a polygon mirror for deflecting the emitted laser beam, whereby the deflected laser beam is projected as a scanning laser beam LB, as shown in FIG. 1.

The printing unit 10 includes a photosensitive drum 14, which is rotated in a direction indicated by an arrow A in FIG. 1, during a printing operation, and a main charger or corona discharger 16 for producing a uniform distribution of positive charges on a surface of the photosensitive drum 14. During a scanning operation of the laser beam scanner 12, the laser beams LB are modulated in accordance with a series of image pixel data, and thus an electrostatic latent image is successively written on the charged surface of the rotating photosensitive drum 14.

The printing unit 10 further includes a developing unit 18 for developing the electrostatic latent image with a positively-charged developer, i.e. toner, and a transfer unit for electrostatically transferring the developed toner image to a recording medium RM passing through a clearance between the photosensitive drum 14 and the transfer unit 20 in a direction indicated by an arrow B in FIG. 1. The transfer unit 20 includes a transfer charger or corona discharger 20A for negatively charging the recording medium RM, thereby electrostatically transferring the positively-charged toner image to the recording medium RM, and a charge-eliminator 20B for eliminating the negative charges from the recording medium RM, thereby preventing the recording medium RM from being electrostatically entangled by the photosensitive drum 14.

Note, in FIG. 1, reference 22 indicates a toner cleaner for removing residual toner particles, not transferred to the recording medium RM, from the photosensitive drum 14.

The corona dischargers 16 and 20A produce ozone during electrical energization thereof, and thus the air included in the aforementioned semi-closed space contains ozone. The air containing ozone must not be permitted to flow out of the printer housing, ozone being harmful to human health. To this end, the printing unit 10 is provided with an ozone-eliminator system, generally indicated by reference 24 in FIG. 1, which comprises an enclosure 26 arranged at the base of the printing unit 10 and forming a lower part of the semi-closed space, and an ozone-exhaust duct 28 communicating with the enclosure 26.

Figure 2:
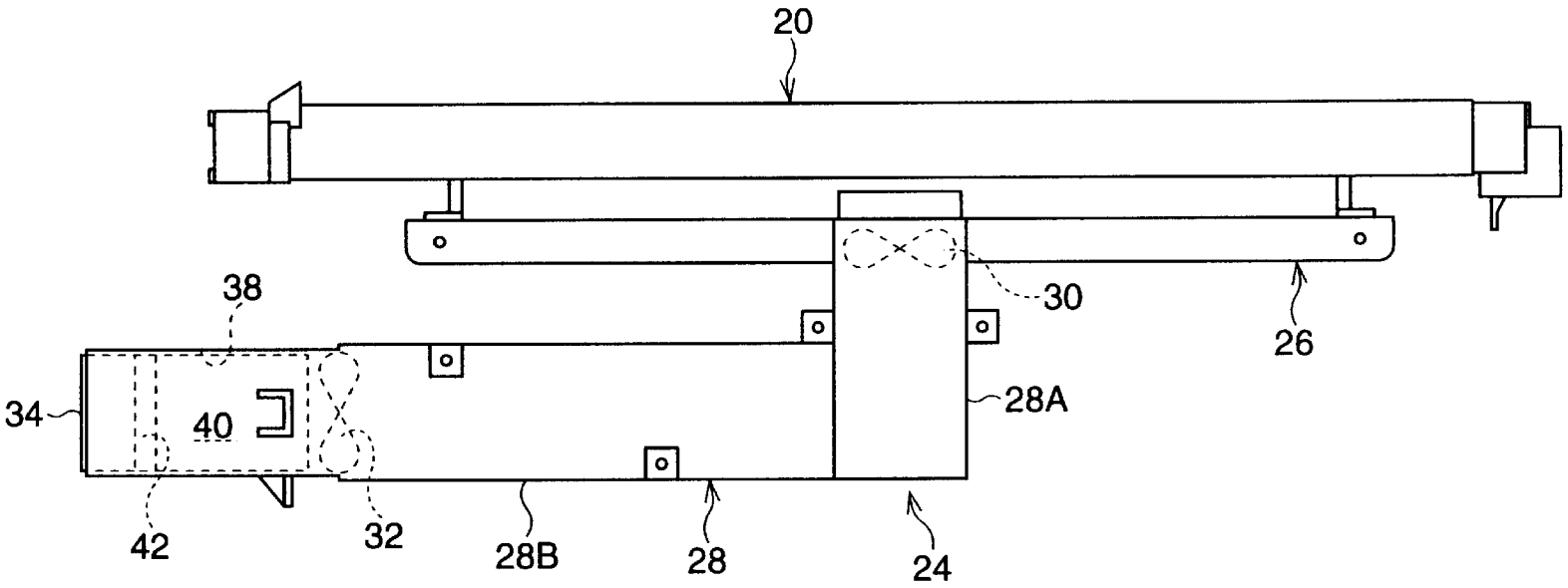
FIG. 2 is a plan view showing an ozone-eliminator system of the electrophotographic printer of FIG. 1.
Figure 3:
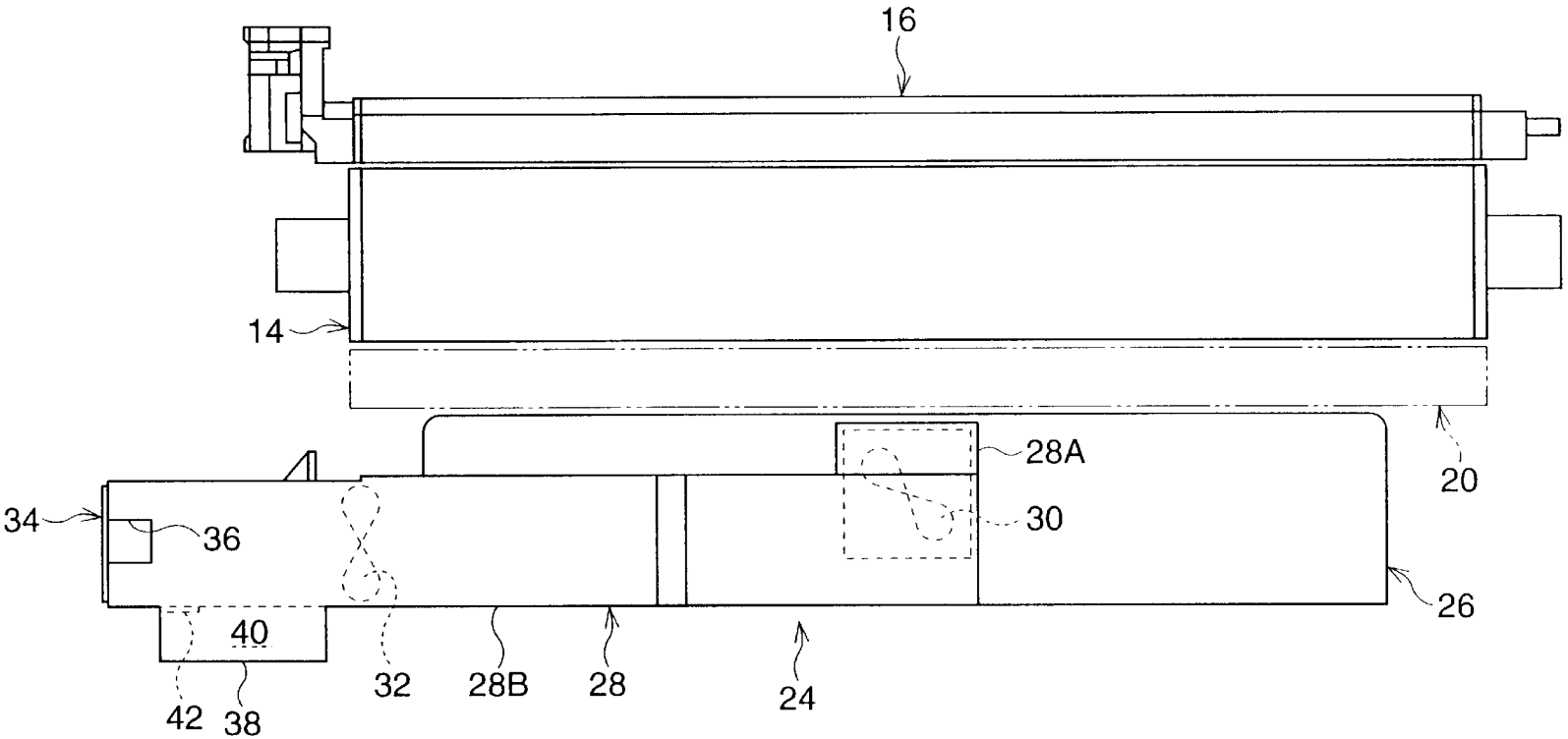
FIG. 3 is an elevation view showing the ozone-eliminator system of the electrophotographic printer of FIG. 1.

As is apparent from FIGS. 2 and 3, the ozone-exhaust duct 28 includes a first duct section 28A extending from the enclosure 26 in the same direction as the recording medium RM is moved (as indicated by the arrow B), and a second duct section 28B perpendicularly extending from the first duct section 28A and terminating at an exit opening, which is shown as a rectangular opening in FIG. 1. The first duct section 28A is provided with a first fan 30 positioned at an entrance opening thereof, with the entrance opening being shown as a rectangular area by broken lines in FIG. 3. The second duct section 28B is also provided with a second fan 32 positioned near the exit opening thereof.

The second duct section 28B is further provided with an ozone-filter 34 detachably and exchangeably inserted in the exit end thereof, and the ozone-filter 34 contains an ozone-absorber such as activated charcoal. In order to facilitate insertion and removal of the ozone-filter 34 into and from the exit end of the second duct section 28B, a pair of notches 36 is formed in the end edges of the second duct section 28B, defining the exit opening thereof, only one of which is visible in FIG. 3. Namely, due to the existence of the notches 36, the insertion and removal of the ozone-filter 34 into and from the exit end of the second duct section 28B can be easily performed by pinching the sides of the ozone-filter with, for example, a thumb and a forefinger of a human hand.

The first fan 30 is driven by a suitable electric motor associated therewith, such that a negative pressure is produced in the aforementioned semi-closed space, so that the air containing ozone is sucked from the semi-closed space into the first duct section 28A of the ozone-exhaust duct 28. Also, the second fan 32 is driven by a suitable electric motor associated therewith, such that the sucked air is discharged outside through the second duct section 28B of the ozone-exhaust duct 28. When the air containing ozone passes through the ozone-filter 34, the ozone is eliminated from the air, thereby preventing the outflow of the ozone from the printer housing.

As discussed hereinbefore, the air, sucked from the semi-closed space, further contains paper dust particles derived from the recording paper RM, and toner particles derived from the toner developer used in the developing unit 18, and these dust particles are captured by the ozone-filter 34, thereby causing the obstruction of the ozone-filter 34. Of course, when the ozone-filter is obstructed with the dust particles, it is impossible to ensure an effective elimination of the ozone from the air.

In order to prolong an operating life of the ozone-filter 34 as long as possible, it is necessary to retard the obstruction of the ozone-filter 34. To this end, the second duct section 28B features a dust trapper 38 provided under the exit end portion thereof near the ozone-filter 34.

Figure 4:
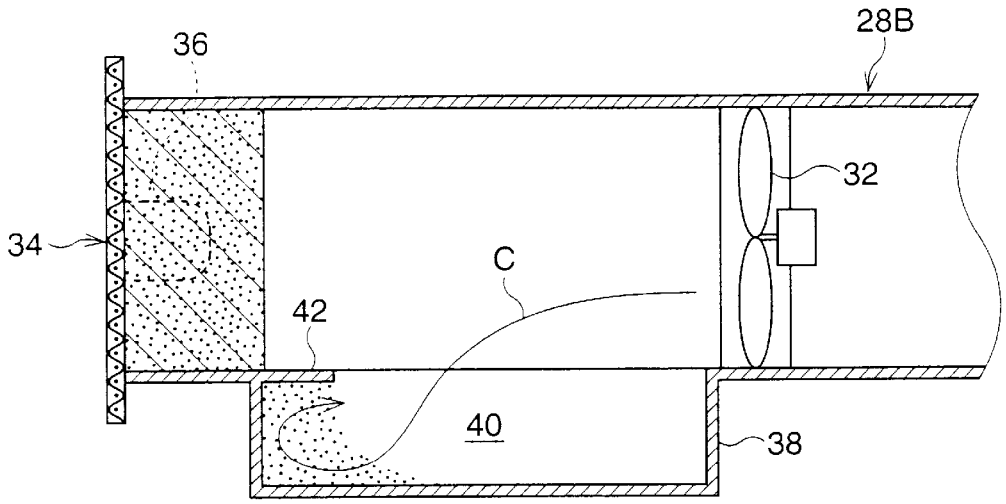
FIG. 4 is a longitudinal-sectional view of an exit-structure of an ozone-exhaust duct of the ozone-eliminator system according to the present invention.

As best shown in FIG. 4, the dust trapper 38 defines a dust-trapping chamber 40 such that a cross-sectional area of the exit end portion of the second duct section 28B is increased in comparison with a cross-sectional area of a remaining portion of the second duct section 28B. Namely, a volume of the exit end portion of the second duct section 28B is increased due to the dust-trapping chamber 40 of the dust trapper 38. Thus, a velocity of the air, introduced from the remaining portion of the second duct section 28B into the exit end portion thereof, slows down, due to the existence of the ozone-filter 34 and the increased volume of the exit end portion of the second duct section 28B, whereby a part of the dust particles, contained in the introduced air, falls into the dust-trapping chamber 40 of the dust trapper 38, due to gravity. Namely, part of the dust particles, contained in the introduced air, are trapped by the dust trapper 38. Accordingly, it is possible to retard the obstruction of the ozone-filter 34, resulting in the prolongation of the operating life of the ozone-filter 34.

Preferably, as shown in FIG. 4, a plate-like element 42 is provided in the vicinity of the ozone-filter 34 so as to be partially projected from a lower side of the ozone-filter 34 along a boundary between the dust-trapping chamber 40 of the dust trapper 38 and the exit end portion of the second duct section 28B. The plate-like element 42 is associated with and cooperates with the dust trapper 38 such that the dust particles, once trapped in the dust-trapping chamber 40 of the dust trapper 38, are prevented from being directed to the ozone-filter 34, as indicated by an arrow C in FIG. 4. Namely, the plate-like element 42 serves as a barrier element to hinder an escape of the trapped dust particles from the dust-trapping chamber 40 of the dust trapper 38.

Of course, when the ozone-filter 34 is exchanged with a fresh ozone-filter, the trapped dust particles are removed from the dust-trapping chamber 40 of the dust trapper 38. The removal of the trapped dust particles from the dust-trapping chamber 40 may be periodically carried out before the exchange of the ozone-filter 34 with the fresh one, so that the operating life of the ozone-filter 34 can be further prolonged.

Figure 5:
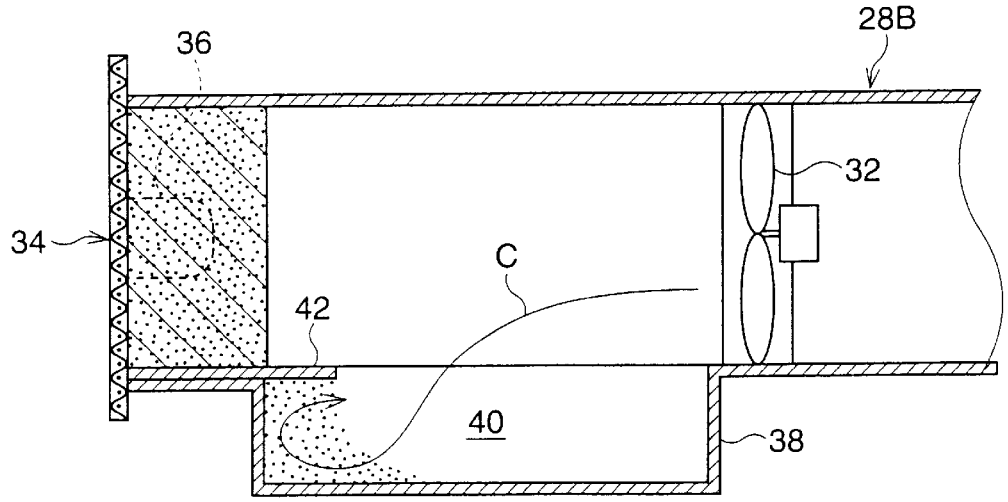
FIG. 5 is a longitudinal-sectional view, similar to FIG. 4, showing a modification of the embodiment shown in FIG. 4.

In the embodiment shown in FIG. 4, the barrier element or plate-like element 42 is integrally formed as a part of the second duct section 28B. Nevertheless, the barrier element 42 may be formed as a part of the ozone-filter 34, as shown in FIG. 5. In this modified embodiment, it is possible to easily carry out the removal of the trapped dust particles from the dust-trapping chamber 40, because the barrier element 42 is taken off from the dust trapper 38 when the ozone-filter 34 is detached from the exit end of the second dust section 28B.

Figure 6:
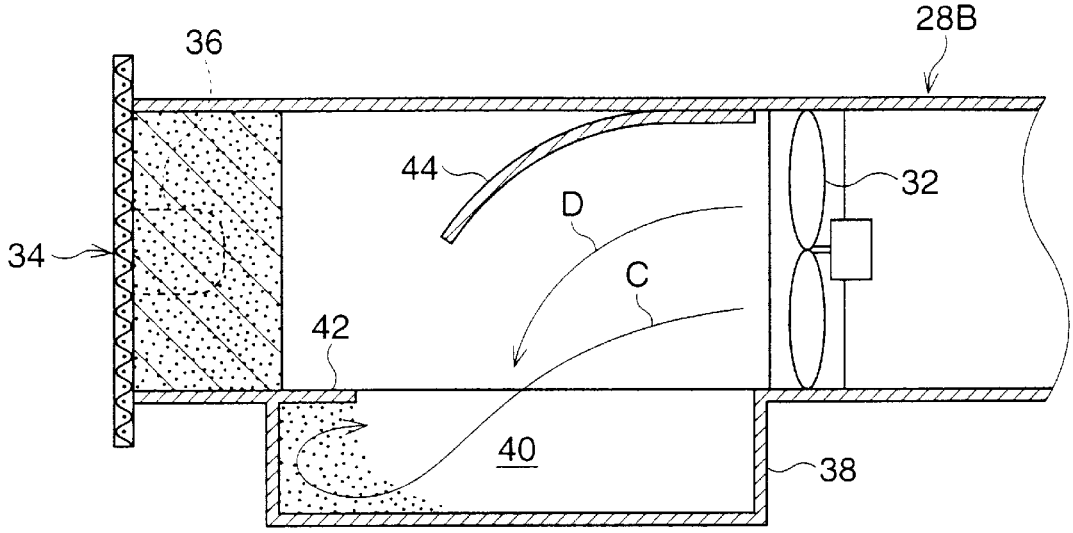
FIG. 6 is a longitudinal-sectional view, similar to FIG. 4, showing another modification of the embodiment shown FIG. 4.

Preferably, as shown in FIG. 6, a guide element 44 is provided in the exit end portion of the second duct section 28B duct such that the air, introduced from the remaining portion of the second duct section 28B into the exit end portion thereof, is positively directed toward the dust-trapping chamber 40 of the dust trapper 38, as indicated by an arrow D in FIG. 6. In particular, the guide element 44 is formed as a guide plate, which is securely attached to an inner surface of a top wall of the exit end portion of the second duct section 28B, and which is gradually and downwardly curved, thereby obtaining the positive direction of the introduced air toward the dust-trapping chamber 40 of the dust trapper 38.

The aforementioned ozone-eliminator system 24 is usually housed in the printer housing, and thus a part of a side wall of the printer housing is removable to access the exit end of the second duct section 28B for exchanging the ozone-filter 34 with a fresh ozone-filter. Of course, if necessary, the exit end of the second duct section 28B may be extended through the side wall of the printer housing.

Finally, it will be understood by those skilled in the art that the foregoing description is of preferred embodiments of the structure, and that various changes and modifications may be made to the present invention without departing from the spirit and scope thereof.

The present disclosure relates to subject matter contained in Japanese Patent Application No. 10-314191 (filed on Nov. 5, 1998), which is expressly incorporated herein, by reference, in its entirety.

What is claimed is:

1. An exit-structure, associated with an ozone-filter, of an ozone-exhaust duct incorporated in an electrophotographic image-forming apparatus to exhaust air, containing ozone and dust particles, which comprises:

a dust trapper that is provided under an exit end portion of said ozone-exhaust duct near said ozone-filter to define a dust-trapping chamber such that a cross-sectional area of the exit end portion of said ozone-exhaust duct is increased in comparison with a cross-sectional area of a remaining portion of said ozone-exhaust duct.

2. An exit-structure as set forth in claim 1, further comprising a barrier element associated with said dust trapper and provided in the vicinity of said ozone-filter, such that the dust particles, once trapped in the dust-trapping chamber of said dust trapper, are prevented from being directed to said ozone-filter.

3. An exit-structure as set forth in claim 2, wherein said barrier element is shaped as a plate-like element, which is partially projected from a lower side of said ozone-filter along a boundary between the dust-trapping chamber of said dust trapper and the exit end portion of said ozone-exhaust duct.

4. An exit-structure as set forth in claim 3, wherein said plate-like element is formed as a part of said ozone-exhaust duct.

5. An exit-structure as set forth in claim 3, wherein said plate-like element is formed as a part of said ozone-filter.

6. An exit-structure as set forth in claim 1, further comprising a guide element provided in the exit end portion of said ozone-exhaust duct such that the air, introduced from the remaining portion of said ozone-exhaust duct into the exit end portion thereof, is positively directed toward the dust-trapping chamber of said dust trapper.

7. An exit-structure as set forth in claim 6, wherein said guide element is formed as a guide plate, which is securely attached to an inner surface of a top wall of the exit end portion of said ozone-exhaust duct, and which is gradually and downwardly curved, thereby obtaining the positive direction of the introduced air toward the dust-trapping chamber of said dust trapper.

* * * * *